US005158142A

United States Patent [19]

Miszewski et al.

[11] Patent Number: 5,158,142

[45] Date of Patent: Oct. 27, 1992

[54] APPARATUS FOR RELEASING A PIPE STRING FROM AN OBJECT STUCK DOWNHOLE BY CONTINUOUSLY APPLYING TENSION TO SAID APPARATUS

[75] Inventors: Antoni K. L. Miszewski, Missouri City; Klaus B. Huber; Joe C. Hromas, both of Sugar Land, all of Tex.

[73] Assignee: Schlumberger Technology Corporation, Houston, Tex.

[21] Appl. No.: 722,041

[22] Filed: Jun. 27, 1991

[51] Int. Cl.[5] ..... E21B 17/06; E21B 31/00

[52] U.S. Cl. ..... 166/377; 166/237; 166/242; 166/301; 285/2; 294/86.18

[58] Field of Search ..... 166/377, 237, 242, 301, 166/98; 175/320, 321; 285/2, 922, 1; 294/86.18, 86.21, 86.17, 86.19

[56] References Cited

U.S. PATENT DOCUMENTS

| | | | |
|---|---|---|---|
| 1,973,137 | 9/1934 | Beck | 285/922 |
| 3,373,817 | 3/1968 | Cubberly, Jr. et al. | 294/86.18 X |
| 3,387,863 | 6/1968 | Treese | 285/2 |
| 4,526,233 | 7/1985 | Stout | 166/377 |
| 4,566,544 | 1/1986 | Bagley et al. | 175/4.56 |
| 4,576,229 | 3/1986 | Brown | 175/321 |
| 4,728,124 | 3/1988 | Righi et al. | 285/2 |
| 4,765,409 | 8/1988 | McClure et al. | 166/297 |
| 4,776,393 | 10/1988 | Forehand et al. | 166/55.1 |
| 4,815,540 | 3/1989 | Wallbillich, III | 166/377 |
| 4,877,089 | 10/1989 | Burns | 166/377 |

FOREIGN PATENT DOCUMENTS

| | | | |
|---|---|---|---|
| 236915 | of 0000 | European Pat. Off. | 175/320 |
| 1234055 | 6/1971 | United Kingdom | 285/1 |

OTHER PUBLICATIONS

"Production Packer Equipment and Services," OTIS Catalogue, p. 95, Otis Tubing Safety Joint.

"Production Packer Equipment and Services," OTIS Catalogue, p. 103, Otis Dual Zone, Swivel Shear Subs. Baker Packers Catalogue, p. 461, Model "SA" Wireline Retrievable Safety Valve Lock, and One Trip Shear--Out Safety Joint.

Baker Packer Catalogue, p. 581, Left-Hand Safety Connector, Safety Joint, Shear-Out Safety Joint, Model "B" Shear-Out Safety Joint, Model C Rotationally Locked Shear-Out Safety Joint, and Blast Joint.

*Primary Examiner*—Hoang C. Dang

*Attorney, Agent, or Firm*—Henry N. Garrana; John H. Bouchard

[57] ABSTRACT

A tension actuated device is adapted to be connected between a pipe string and an object stuck downhole in a wellbore and does not disconnect the pipe string from the object in response to a transient or temporary shock load that is temporarily applied to the pipe string. Rather, the tension actuated device selectively disconnects the pipe string from the object stuck downhole by continuously applying a pulling force of a predetermined magnitude to the device via the pipe string for a predetermined period of time. The tension actuated device includes an inner member adapted to be connected to an object stuck downhole, an outer member connected to the inner member and adapted to be connected to the pipe string, and a compressible material disposed between the inner and outer members, the compressible material being compressed and the inner member being disconnected from the outer member when a pulling force of predetermined magnitude is continuously applied to the outer member via the pipe string for a predetermined period of time. Transient loads cannot release the inner member from the outer member of the device because typical transient loads do not apply a force, of the predetermined magnitude, to the pipe string for a long enough period of time.

16 Claims, 1 Drawing Sheet

APPARATUS FOR RELEASING A PIPE STRING FROM AN OBJECT STUCK DOWNHOLE BY CONTINUOUSLY APPLYING TENSION TO SAID APPARATUS

BACKGROUND OF THE INVENTION

The subject matter of the present invention pertains to wellbore apparatus, and more particularly, to an apparatus interconnected between a pipe string and an object stuck in a wellbore and responsive to a pair of oppositely directed forces applied to opposite ends of said apparatus for releasing the pipe string from the object in response to a controlled application of the pair of oppositely directed forces to the apparatus.

When downhole tools, particularly a packer or perforating gun, are suspended from a pipe string in a wellbore, the tools may occasionally become stuck in the wellbore. When this happens, it may become necessary or desirable to disconnect the pipe string from the stuck tools. Devices designed to disconnect the pipe string from the stuck tools do exist in the prior art. Such devices include left hand thread safety connectors, simple tension shear out safety joints, wireline armed shear out safety joints, and wireline actuated pipe string releases. However, several disadvantages are associated with such prior art devices.

For example, tension actuated devices, having no protection against transient loads, must have their shear out level set higher than any expected transient shock loads, even though the duration of such transient shock loads is very short. Consequently, when an intentional actuation of the device is desired, a pulling force applied to the device, which is required to disconnect the pipe string from a stuck object in the wellbore, may be higher than a maximum threshold pulling force that a rig is capable of safely applying to the device.

Rotational devices, ones that require a left hand rotation of the pipe string to disconnect the pipe string from the device and release the pipe string from the device stuck downhole, are not susceptible to transient loads; however, such devices are susceptible to accidental actuation when an unrelated left hand rotation is applied to the pipe string. In addition, when the pipe string is disposed in a deviated well and it is necessary to disconnect the pipe string from an object stuck downhole, it is difficult to transmit the required torque to one end of the pipe string in order to rotate the pipe string and disconnect the pipe string from the device.

Wireline operated devices, ones which disconnect a pipe string from an object stuck downhole when a wireline is connected to the device and a required pulling force is applied to the wireline, require a clear path through the pipe string in order to connect the wireline to the device. Such devices are not suitable in cases where no clear path exists through the pipe string. For example, no clear path exists in a gun string or when there are items blocking the path in the pipe string, such as a drill stem test valve. This is especially true when sanding causes the object to be stuck downhole.

SUMMARY OF THE INVENTION

Accordingly, it is a primary object of the present invention to disclose a tension actuated device, which is adapted to be connected between a pipe string and an object stuck downhole, such as a perforating gun or packer, for providing protection against transient shock loads by disconnecting the pipe string from the object stuck downhole only when a pulling force of predetermined magnitude and is continuously applied to the pipe string for a predetermined period of time.

It is a further object of the present invention to disclose the tension actuated device, which provides protection against transient shock loads, including an inner member adapted to be connected to an object stuck downhole, an outer member connected to the inner member and adapted to be connected to the pipe string, and a compressible means disposed between the inner and outer members, the compressible means being compressed and the inner member being disconnected from the outer member when a pulling force of predetermined magnitude is continuously applied to the outer member via the pipe string for a predetermined period of time.

It is a further object of the present invention to disclose the tension actuated device, which provides protection against transient shock loads, including an inner member, an outer member, a compressible means and an isolation piston having resilient latch fingers disposed between the inner member and the outer member, the outer member including an outer housing and a support adaptor connected to a bottom part of the outer housing, the inner member including a latch receptacle adapted to receive the latch fingers, the support adaptor of the outer member slowly compressing the compressible means when a pulling force of a predetermined magnitude is continuously applied to the outer housing of the outer member via the pipe string, the outer member separating from the inner member when the compressible means is compressed to a predetermined extent and the latch finger is expanded and disconnected from the latch receptacle in response to the continuous application of the pulling force to the outer member via the pipe string.

These and other objects of the present invention are accomplished and fulfilled by disclosing a tension actuated device which is adapted to be connected between a pipe string and an object stuck downhole in a wellbore and which does not disconnect the pipe string from the object in response to a transient or temporary shock load that is temporarily applied to the pipe string. The tension actuated device of the present invention selectively disconnects the pipe string from the object stuck downhole when a pulling force is applied by continuously applying the pulling force of a predetermined magnitude to the device for a predetermined period of time via the pipe string. The tension actuated device includes an inner member adapted to be connected to the object stuck downhole, such as a packer or perforating gun, the inner member including a latch receptacle; and an outer member including an outer housing adapted to be connected to the pipe string and a support adaptor connected to the outer housing. An isolation piston is disposed between the inner and outer members, the piston including a resilient latch member or locking finger which is adapted to latch or mate with the latch receptacle on the inner member. A compressible means is also disposed between the support adaptor of the outer member and the isolation piston. When the object is stuck downhole, the inner member of the device, connected to the object, is fixed in position. Initially, the isolation piston locking fingers are latched to the latch receptacle on the inner member. When an upward pulling force, of predetermined magnitude, is continuously applied to the pipe string, the outer housing and support adaptor move with respect to the inner member, and the compressible means is slowly compressed between the support adaptor and the isolation piston. As long as the pulling force, of predetermined magnitude, is continuously applied to the pipe string, the compressible means continues to undergo compression. Eventually, during the compression, the support adaptor unlocks the locking fingers on the isolation piston from the latch receptacle on the inner member thereby releasing the inner member from the outer member of the device and releasing the pipe string from the object stuck downhole. An oil metering orifice is disposed through the isolation piston; and the compressible means includes oil disposed between the inner member and outer housing, crushable elements and a spring stack also disposed between the inner member and outer housing. As the outer housing moves with respect to the inner member in response to the continuous application of the pulling force to the pipe string, the oil slowly moves through the oil metering orifice. In addition, the movement of outer housing with respect to the inner member compresses the spring stack before crushing the crushable elements. When a sufficient quantity of oil moves through the oil metering orifice in the isolation piston, and when the spring stack and crushable elements compress to a predetermined extent, the support adaptor unlocks the locking fingers from the latch receptacle thereby releasing outer member of the device from the inner member and releasing the pipe string from the object stuck downhole. Transient loads cannot release the inner member from the outer member of the device because the duration of typical transient loads do not continuously apply a force, of the predetermined magnitude, to the pipe string to displace sufficient oil through the oil metering orifice and compresses the springs and crushable elements.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
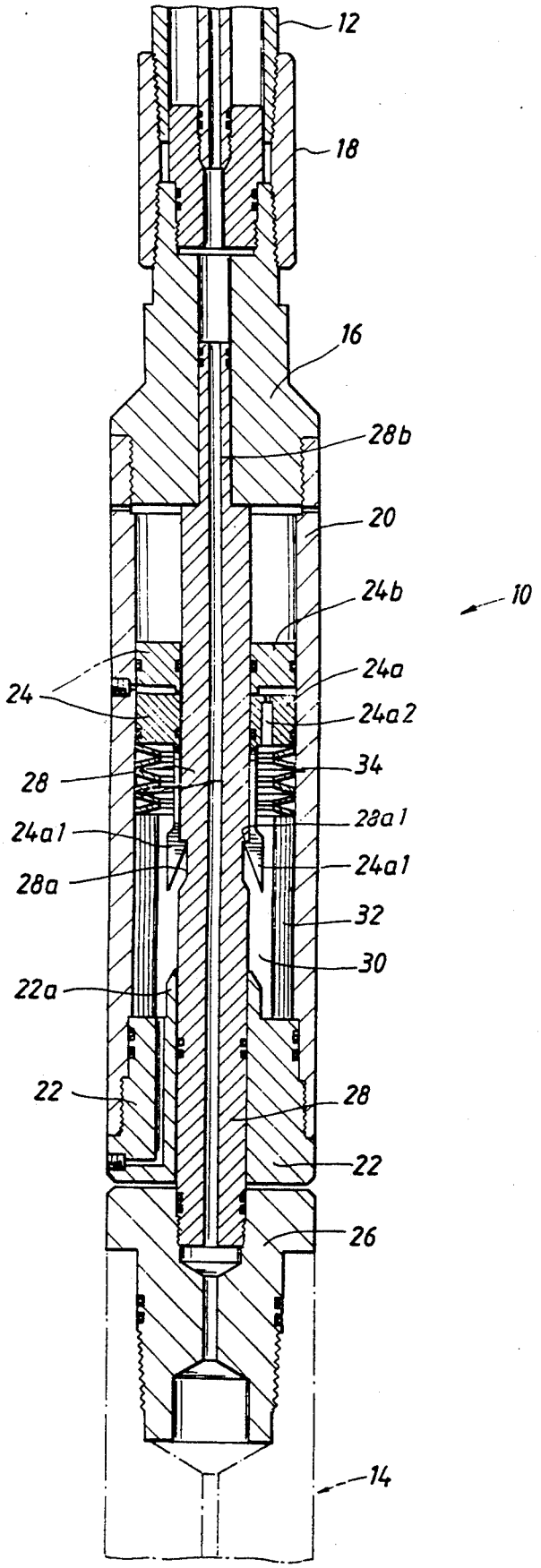
FIG. 1 illustrates the tension actuated device of the present invention.

Referring to FIG. 1, a tension actuated device 10 in accordance with the present invention is illustrated.

In FIG. 1, the tension actuated device 10 is adapted to be connected between a pipe string 12 and an object 14 that is stuck downhole in a wellbore. The object 14 may be a packer or a perforating gun that has become sanded in place within the wellbore. The tension actuated device 10 includes an inner member and an outer member disposed around and connected to the inner member and defining a space between the inner and outer members.

The outer member includes an end piece 16 threadedly connected to pipe string 12 via a collar 18, an outer housing 20 threadedly connected to the end piece 16, a support adaptor 22 including a release profile 22*a* integrally connected thereto that is threadedly connected to a bottom part of the outer housing 20, and an isolation piston 24 disposed within the space between the inner and outer members. The isolation piston 24 includes a first isolation piston 24*a* and a second isolation piston 24*b* disposed adjacent but not connected to the first isolation piston 24*a*. The first isolation piston 24*a* includes resilient latch or locking fingers 24*a*1 extending axially from the first piston 24*a* and an oil metering orifice 24*a*2 disposed through the piston 24*a* which communicates the space between the inner and outer members with another space disposed between the first isolation piston 24*a* and the second isolation piston 24*b*.

The inner member includes a further end piece 26 connected to the object 14 stuck downhole and a mandrel 28, one end of which is threadedly connected to the further end piece 26, the mandrel 28 including a latch receptacle 28*a* having a shoulder 28*a*1 which is adapted to receive the latch or locking finger 24*a*1 and a nose portion 28*b* integrally connected to the other end of mandrel 28, the nose portion 28*b* having a diameter which is less than the diameter of the mandrel 28. The nose portion 28*b* is adapted to be sealably inserted into the end piece 16 of the outer member as shown in FIG. 1. The isolation piston 24 (inclusive of first and second isolation pistons 24*a* and 24*b*) is disposed between the outer housing 20 of the outer member and the mandrel 28 of the inner member, the piston 24 being initially fixed in position when the locking finger 24*a*1 on the first isolation piston 24*a* is latched on shoulder 28*a*1 of the latch receptacle 28*a* of the mandrel 28. When the locking fingers 24*a*1 are latched on shoulder 28*a*1, a contact point is formed, which contact point holds the inner and outer members of the tension actuated device 10 together.

A compressible means is disposed in the space between the inner and outer members, and more particularly, between the outer housing 20 and the mandrel 28 and between the first isolation piston 24*a* and the support adaptor 22. The compressible means includes the following three elements: (1) oil 30 disposed in the space between the outer housing 20 and mandrel 28, the oil 30 being adapted to transfer through the oil metering orifice 24*a*2 when support adaptor 22 moves toward the first isolation piston 24*a*, (2) crushable elements 32 disposed between the support adaptor 22 and the first isolation piston 24*a* and adapted to permanently deform when the support adaptor 22 moves toward isolation piston 24 relative to mandrel 28, and (3) a spring stack 34 disposed between the crushable elements 32 and the first isolation piston 24*a*. The spring stack 34 compensates for relative movement of the inner and outer members in response to an applied force due to the compressibility of the oil 30; this prevents undesirable precrushing of the crushable elements 32.

In operation, referring to FIG. 1, the tension actuated device 10 is disposed in a wellbore and is initially connected between the object 14 stuck downhole and the pipe string 12. The locking fingers 24*a*1 latch with the latch receptacle 28*a* as shown in FIG. 1. Spring stack 34 is only partly compressed by string weight, oil 30 is disposed within the space between crushable elements 32 and mandrel 28, and crushable elements 32 remain in their original un-deformed condition. An operator at the well surface exerts an upward pulling force on pipe string 12, the pulling force being continuously applied to pipe string 12 and having a predetermined magnitude for a predetermined period of time. Therefore, end piece 16, outer housing 20, and support adaptor 22 all move in synchronism with the movement of pipe string 12. Further, end piece 26 and mandrel 28 also attempt to move upwardly in FIG. 1, since locking fingers 24a1 are firmly latched within latch receptacle 28a on mandrel 28. Furthermore, isolation piston 24 cannot move since locking fingers 24a1 are latched within latch receptacle 28a. Consequently, movement of outer housing 20 and support adaptor 22 upwardly in FIG. 1 in synchronism with the pull upwardly on pipe string 12 tends to simultaneously compress then meter the oil 30 through the oil metering orifice and compress the spring stack 34. Since the upward pulling force is continuously applied and has a predetermined magnitude for a predetermined period of time, the spring stack 34 compresses to its fullest extent and the oil continues to flow through the oil metering orifice 24a2. During the compression of spring stack 34, the release profile 22a on support adaptor 22 is approaching the locking fingers 24a1. When the spring stack 34 is compressed to its fullest extent, the crushable elements 32 begin to permanently deform, and the oil 30 still flows through the oil metering orifice 24a2. Eventually, the release profile 22a contacts the locking fingers 24a1 thereby expanding and releasing the fingers 24a1 from the shoulder 28a1 of latch receptacle 28a releasing the outer member from the inner member of the tension actuated device 10. In response to a further pull on pipe string 12, the outer member including the end piece 16, outer housing 20, support adaptor 22, and isolation piston 24 slide over the inner member including mandrel 28 thereby allowing the outer member to separate from the inner member and allowing pipe string 12 to separate from the object 14 stuck downhole.

If a temporary, transient shock load provides a sudden force on pipe string 12 or object 14, the magnitude and/or duration of the sudden force does not provide a sufficient force or allow sufficient time for the oil 30 to flow through orifice 24a2 and for the spring stack 34 and crushable elements 32 to compress sufficiently to disengage locking fingers 24a1 from the latch receptacle 28a. Therefore, transient shock loads cannot disconnect the pipe string 12 from the object stuck downhole, rather, only a continuously applied upward pulling force, of a predetermined magnitude, applied to pipe string 12 for a predetermined period of time disengages the pipe string 12 from the object 14 stuck downhole.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Apparatus adapted to be connected between a pipe string and an object stuck in a wellbore for disconnecting the pipe string from the object, comprising:

disconnection means responsive to a continuously applied pulling force of predetermined magnitude applied to said pipe string for a predetermined period of time for disconnecting said pipe string from said object stuck in said wellbore, said disconnection means including, an inner member adapted to be connected to said object, an outer member connected to the inner member and adapted to be connected to the pipe string, and compressible means disposed between the inner and outer members for compressing in response to a compression force applied thereto, the compressible means being compressed and the inner member being disconnected from the outer member when said pulling force of predetermined magnitude is continuously applied to said outer member for said predetermined period of time via said pipe string, said compressible means including one or more crushable elements adapted to be compressed and permanently deformed in response to said compression force.

2. The apparatus of claim 1, wherein the disconnection means further comprises:

an isolation piston including a latch means disposed between the inner member and the outer member, the latch means latching onto a latch receiving means, said outer member including an outer housing and support means connected to said outer housing for providing support for at least a part of said compressible means, said inner member including said latch receiving means for receiving said latch means.

3. The apparatus of claim 2, wherein said support means compresses said compressible means when said pulling force of said predetermined magnitude is continuously applied for said predetermined period of time to said outer housing via said pipe string, said latch means being disconnected from said latch receiving means when said compressible means is compressed to a predetermined extent in response to said continuously applied pulling force of said predetermined magnitude applied to said outer housing via said pipe string.

4. The apparatus of claim 3, wherein the isolation piston further includes an orifice disposed therethrough, and wherein said compressible means further comprises:

a fluid disposed between the crushable elements and the inner member and adapted to flow through said orifice when said support means compresses said fluid and subsequently deforms said crushable elements.

5. The apparatus of claim 4, wherein the compressible means further comprises:

spring means disposed between the crushable elements and the isolation piston for compressing when said fluid is compressed by said support means and when said support means compresses said crushable elements.

6. Apparatus adapted to be connected between a pipe string and an object stuck in a wellbore for disconnecting the pipe string from the object, comprising:

disconnection means responsive to a short duration transient force load for retaining the connection between said pipe string and said object, said disconnection means disconnecting said pipe string from said object in response to a continuously applied pulling force of predetermined magnitude applied to said pipe string for a predetermined period of time, said disconnection means including, an inner member adapted to be connected to said object, an outer member connected to the inner member and adapted to be connected to the pipe string, compressible means disposed between the inner and outer members for compressing in response to a compression force applied thereto, the compressible means being compressed and the inner member being disconnected from the outer member when said pulling force of predetermined magnitude is continuously applied to said outer member for said predetermined period of time via said pipe string, and an isolation piston including a latch means disposed between the inner member and the outer member, the latch means latching onto a latch receiving means, said outer member including an outer housing and support means connected to said outer housing for providing support for at least a part of said compressible means, said inner member including said latch receiving means for receiving said latch means.

7. The apparatus of claim 6, wherein said support means compresses said compressible means when said pulling force of said predetermined magnitude is continuously applied for said predetermined period of time to said outer housing via said pipe string, said latch means being disconnected from said latch receiving means when said compressible means is compressed to a predetermined extent in response to said continuously applied pulling force of said predetermined magnitude applied to said outer housing via said pipe string.

8. The apparatus of claim 7, wherein said compressible means comprises:

crushable elements disposed between said isolation piston and said support means and between said outer housing and said inner member and adapted to be compressed and permanently deformed by said support means.

9. The apparatus of claim 8, wherein the isolation piston further includes an orifice disposed therethrough, and wherein said compressible means further comprises:

a fluid disposed between the crushable elements and the inner member and adapted to flow through said orifice when said support means compresses and deforms said crushable elements.

10. The apparatus of claim 9, wherein the compressible means further comprises:

spring means disposed between the crushable elements and the isolation piston for compressing when said support means compresses said crushable elements.

11. A method of releasing a pipe string from an object stuck downhole in a wellbore, comprising the step of:

releasing a connection between said pipe string and said object stuck downhole in response to a continuously applied pulling force of predetermined magnitude applied to said pipe string for a predetermined period of time, the releasing step including the steps of, compressing and permanently deforming a crushable element in response to said pulling force applied to said pipe string, the crushable element being permanently deformed when said predetermined period of time has elapsed, and disconnecting said pipe string from said object when the crushable element is deformed.

12. The method of claim 11, further comprising the step of:

retaining the connection between said pipe string and said object stuck downhole in response to a short duration transient force load applied to said pipe string.

13. The method of claim 11, wherein the disconnecting step comprises the steps of:

un-latching a latch means from a latch receiving means when said crushable element is deformed, said pipe string being disconnected from said object when the latch means is un-latched from said latch receiving means.

14. The method of claim 11, wherein the releasing step further including the step of:

further comprising a spring in addition to compressing said crushable element in response to said pulling force applied to the pipe string, said spring being compressed when said predetermined period of time has elapsed, said pipe string being disconnected from said object when the spring is compressed and said crushable element is deformed.

15. The method of claim 14, wherein the releasing step further includes the step of:

further compressing a substantially incompressible fluid and metering said fluid through a metering orifice in addition to compressing said spring and compressing said crushable element in response to said pulling force applied to the pipe string, the fluid being metered through said orifice when said predetermined period of time has elapsed, said pipe string being disconnected from said object when the fluid is metered through said metering orifice, said spring is compressed, and said crushable element is deformed.

16. The method of claim 15, wherein the disconnecting step comprises the steps of:

un-latching means from a latch receiving means when said crushable element is deformed, said spring is compressed, and said fluid is metered through said orifice, said pipe string being disconnected from said object when the latch means is un-latched from said latch receiving means.

* * * * *